United States Patent [19]

Langemeyer et al.

[11] 4,115,978

[45] Sep. 26, 1978

[54] APPARATUS FOR AUTOMATICALLY FILLING AND CLOSING SACKS

[75] Inventors: Carl Langemeyer; Konrad Tetenborg, both of Lengerich Fed. Rep. of Germany

[73] Assignee: Windmoller & Holscher, Lengerich Fed. Rep. of Germany

[21] Appl. No.: 809,653

[22] Filed: Jun. 24, 1977

[30] Foreign Application Priority Data

Jun. 29, 1976 [DE] Fed. Rep. of Germany ..... 2629065

[51] Int. Cl.[2] ..... B65B 43/30

[52] U.S. Cl. ..... 53/570; 53/386

[58] Field of Search ..... 53/187, 188, 384, 386

[56] References Cited

U.S. PATENT DOCUMENTS

| | | | |
|---|---|---|---|
| 2,753,097 | 7/1956 | Kindseth et al. | 53/188 |
| 3,643,399 | 2/1972 | Bertaglio | 53/187 |

*Primary Examiner*—Travis S. McGehee
*Attorney, Agent, or Firm*—Fleit & Jacobson

[57] ABSTRACT

Conveying means which are intermittently rotatable in equal steps take flattened sacks successively from supply means through one step to filling means which are effective to open each sack and fill it, whereupon the conveying means move a further step to take the sack to welding means. Said conveying means comprise two parallel discs turned in synchronism about horizontal shafts which are directed outwardly to define a free passage between the discs. Confronting tongs on the discs are displaceable towards and away from one another to engage the sack at both sides of its mouth at the supply means and convey it up to the welding means at which they deposit the filled sack on a discharge conveyor, the tongs being lowerable towards said discharge conveyor to an extent such that the upper region of each sack becomes buckled.

11 Claims, 16 Drawing Figures

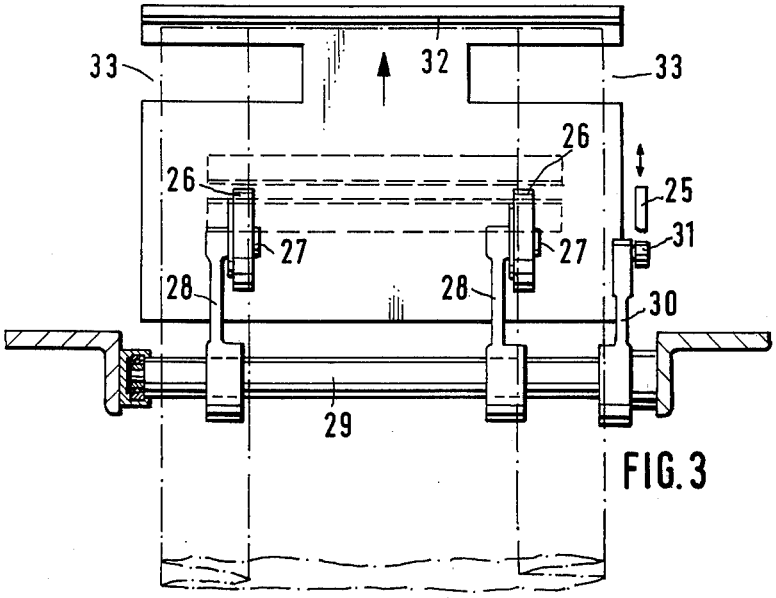
FIG. 3
FIG. 4
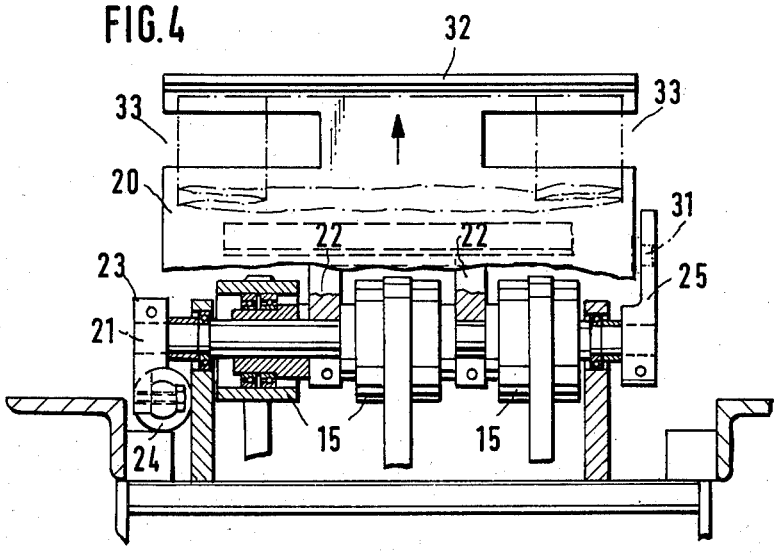

VI
VI
IX
IX
X
XI
XII
37
38
39
40
41
43
44
46
47
49
50
51
52
53
54
55
56
57
58
59
60
61
62
63
64
65
66

APPARATUS FOR AUTOMATICALLY FILLING AND CLOSING SACKS

The invention relates to an apparatus for automatically filling and closing plastics sacks, preferably side-pleated sacks, comprising conveying means which are intermittently rotatable in equal angular steps about a central axis, take the sacks from supply means that are fixed with respect to the frame, transport them through one angular step to filling means which are equipped with means for opening the sack and a lowerable filling funnel, and lead them through a further angular step to welding means, and comprising means for taking the filled sacks away.

Machines for filling and closing sacks are already known in the most varied forms.

In a merry-go-round packager known from DT-AS 1 224 656, the bags to be filled are held by suction means on supporting members for the purpose of filling by the associated filling stations, are opened and again closed, the upper edges of the filled bag being closed in its filling plane by thermowelding and cooling apparatuses which are mounted on supporting arms and follow the same rotary movement of the filling stations through about two thirds of the arcuate spacing from one filling station to the next and are then swung back, whereupon the filled and closed bags are thrown off by a discharging apparatus which is likewise oscillated on one supporting arm. By reason of the fact that the thermowelding, cooling and discharge apparatuses are secured to arms that are carried along and then returned, the known apparatus is complicated, expensive and subject to faults. Close limits are set to the capacity of the known apparatus by the to and fro swinging of the arms carrying the closure and discharge elements.

In an apparatus of the aforementioned kind known from DT-OS 2 301 817 and DT-OS 2 402 589, at a first station the front end of a web of tubular film withdrawn from a supply reel is closed by a transverse welding seam and a section of the desired sack length is severed therefrom. At a second station having displaceable clamping jaws for holding the side pleats of the sack, suction nozzles for opening the margins at the opening of the sack, an insertable filling nipple and means for lifting and lowering the sack, the latter is filled with filling material. At a third station, the filling end of the filled sack is closed by a weld seam and at a fourth station the filled and closed sack is pushed out. The four stations are arranged on the circumference of a circle on a spider which is rotatable about a vertical axis and is provided with four sack supports and conveying cheeks for transporting the sacks from one station to the other. In this known apparatus, the sack to be filled is transferred by the conveying cheeks to the clamping jaws of the filling station and, after filling, return to the conveying cheeks so that a simple sequence of movements enhancing a high capacity becomes impeded and the proper positioning of weld seams for closing the sacks is not ensured.

It is therefore the problem of the invention to provide a simple machine for automatically filling and closing plastics sacks that operates at high capacity with a minimum of break-downs and which ensures a good and tight closure of the filled sacks.

This problem is solved according to the invention in an apparatus of the aforementioned kind in that the conveying means consist of two discs which are overhangingly mounted on horizontal shafts, are parallel to each other and are driven in synchronism, the shafts being mounted in the machine frame to point outwardly to form a free passage between the vertical discs, that confronting tongs are secured in the discs eccentrically offset by one angular step on aligned shafts which are displaceable towards and away from one another and are provided with a controlled rotary drive, which tongs engage the sacks in the supply means at both sides of the single aperture and transport same through the filling means to welding means in which they deposit the filled sack on the discharge conveyor, and that the tongs are lowerable towards same to such an extent that the upper region of the sack is buckled, they pull the rim of the opening taut and turn if through 90°. In the apparatus according to the invention a flattened side-pleated sack is engaged at the region of the side folds by the tongs and led to the filling means. In these the sack is opened by the tongs by pulling apart the side walls whilst the side folds are retained under the pressure of the tongs, and the sack is filled. The filled sack is then placed on the means for taking it away and the side walls are, in the region of the filling aperture, bent at right-angles to the sack whilst retaining the spread filling position of the side walls and they are buckled in the upper region. The spread walls are then pulled taut in the unfilled upper portion of the sack by moving the tongs apart and the sack is closed by a continuous transverse weld seam that also engages the side folds. By placing the sack upright, bending the side walls in the region of the filling aperture through 90° and buckling the unfilled upper portion of the sack, the air disposed above the filling material is pressed out of the sack. After pulling the side walls taut and closing the filling aperture, the side walls lie on one another so that the transverse seam closing the sack can be produced rapidly and reliably. By reason of the fact that the side walls are accessible to the welding appliance in a proper position in the region of the filling aperture and the side folds, the output of the machine can be increased.

By reason of the overhanging mounting of the discs forming the conveying means, a free space is created between them through which the sacks can pass freely. Longer sacks can also be filled and closed in the apparatus of the invention because there is no shaft that might hinder the free passage. The means for supplying the sacks, filling and closing them can be arranged on a small radius so that the dimensions of the apparatus can be kept small as a whole. The conveying tongs lead the sack through all stations of the apparatus according to the invention so that its displacement is impossible and the welding seam will be applied at a correct position.

A holder serving to take the sacks to the filling and closing station and having jaws clamping the margins at the opening of the sacks to be filled at both sides of a central single aperture is known from German Gebruachsmuster Specification No. 1,860,026. To move the gripping tongs towards and away from one another and turn them in the required manner, the shafts carrying same are desirably connected to a sliding sleeve and a pinion. A claw fork driven by a pressure medium piston cylinder unit can engage in the sliding sleeve to provide a simple drive. As an abutment for the sliding sleeve there may be a further pressure medium piston cylinder unit which ensures the intermediate position of the gripping tongs necessary for engaging the sacks.

For driving the pinion, a gear segment may be provided that is driven by a lever which is controlled by a cam and is pressed to the cam by a spring. By means of this the rotary position of the gripping tongs is controlled in relation to the phase position of the discs.

Desirably, protecting plates are attached to the discs behind which the gripping tongs are moved back to the rest position so that the bags or sacks do not make contact with gripping tongs during return movement.

The discs may have teeth at the end, which engage pinions seated on a common shaft in order to ensure synchronous movement of the discs.

Desirably, the means for positioning the sacks ready to be engaged by the gripping tongs are a belt guide comprising a guide plate which carries the front end of the ready positioned sack and is mounted on a shaft pivotable by a pressure medium piston cylinder unit. The guide plate is swung away downwardly by means of the pressure medium piston cylinder unit at the instant in which the sack is withdrawn by the gripping tongs. The rear end of the sack thereby falls and the sack assumes a predominantly vertical position on its way to the filling station so that it can be readily filled.

To take the filled enclosed sacks away a conveyor belt is provided that is adjustable for height so that the sack reaching the closing station rests on the conveyor belt with its base before reaching the welding tongs and is buckled by the gripping tongs so that the air above the filling material escapes.

An example of the invention will now be described in more detail with reference to the drawing, in which:

FIG. 3 is a plan view of the positioning means;

FIG. 4 is a section on the line IV—IV in FIG. 2;

Figure 1:
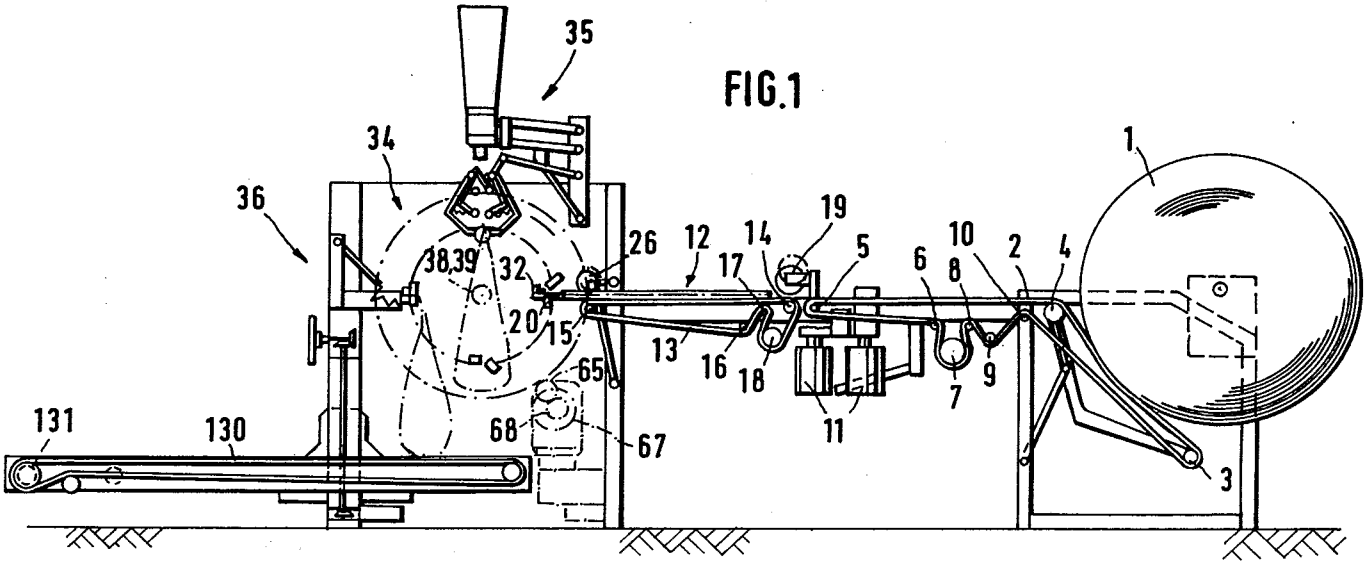
FIG. 1 is an end elevation of the apparatus with means for positioning the sacks in readiness.
Figure 2:
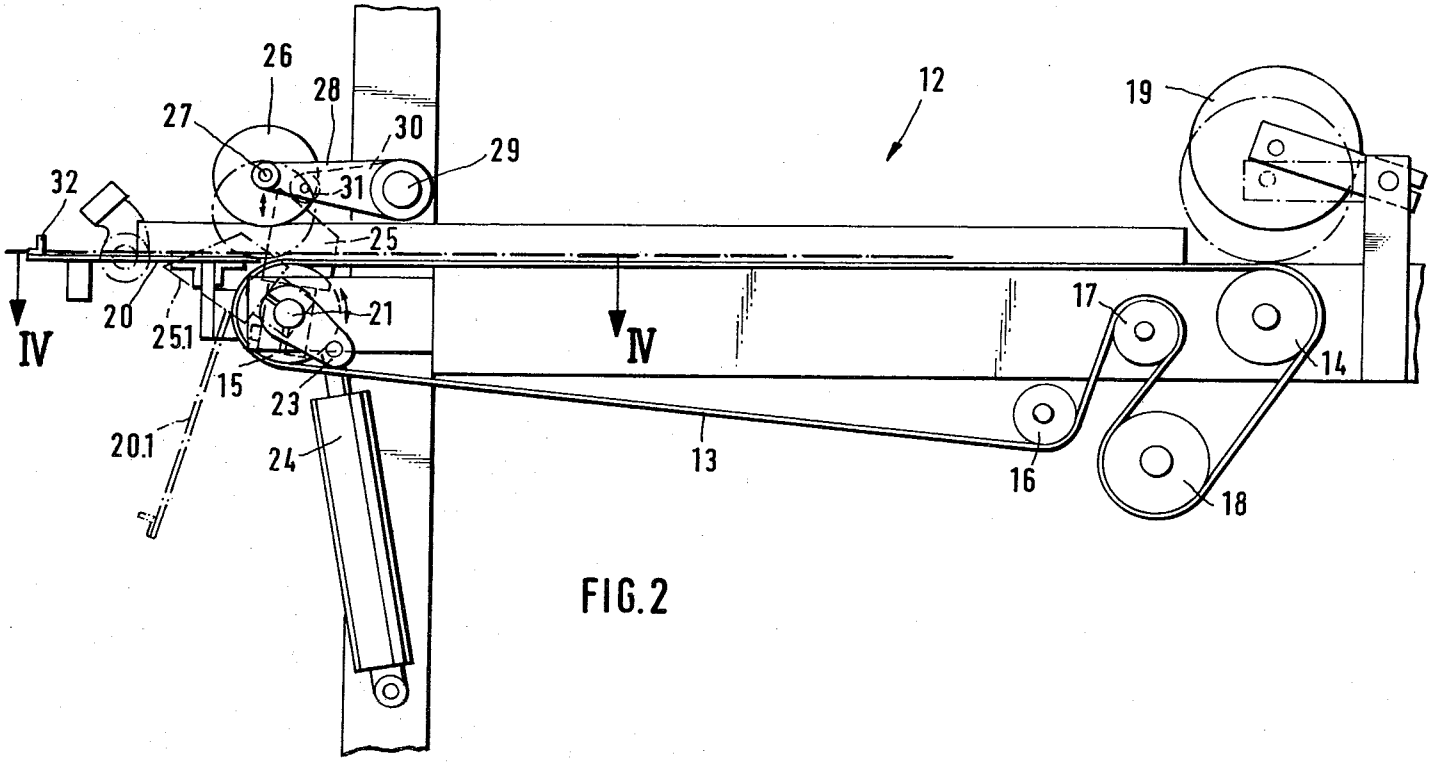
FIG. 2 is an enlarged representation of the positioning means.
Figure 5:
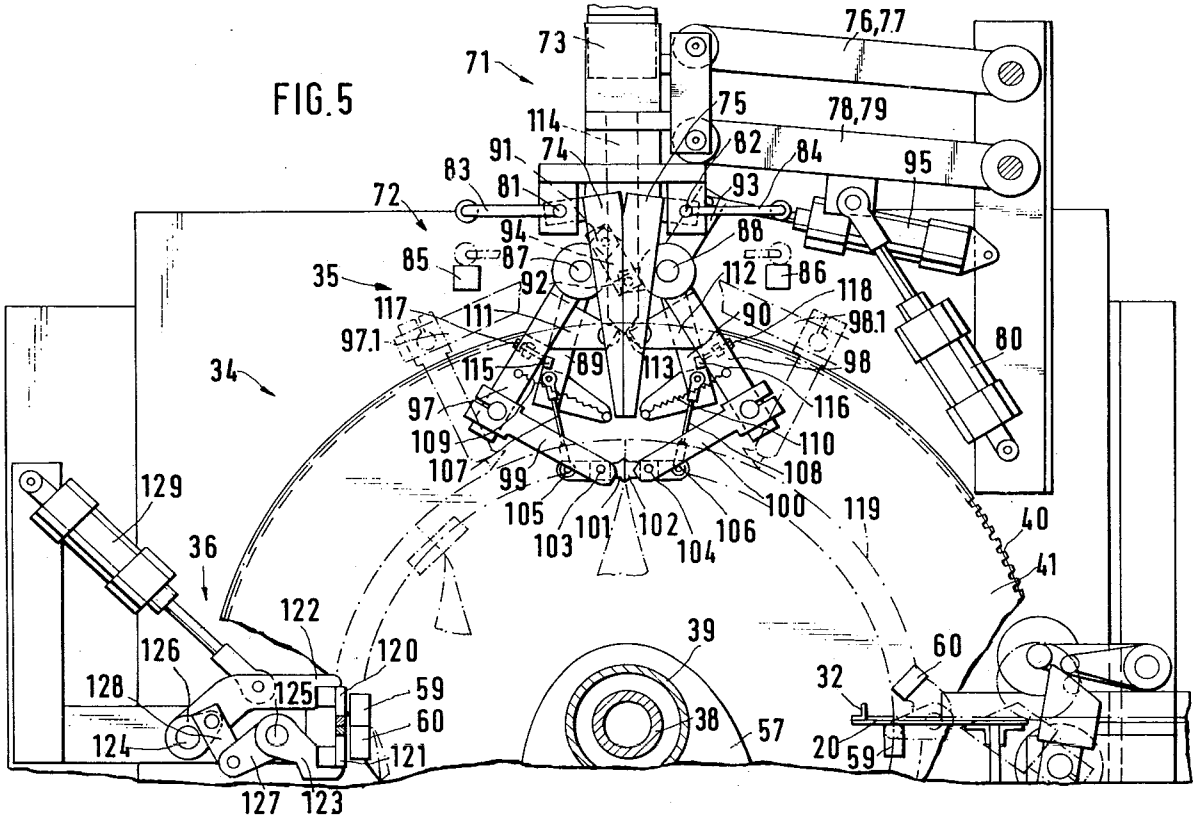
FIG. 5 is an enlarged fragment of FIG. 1.
Figure 6:
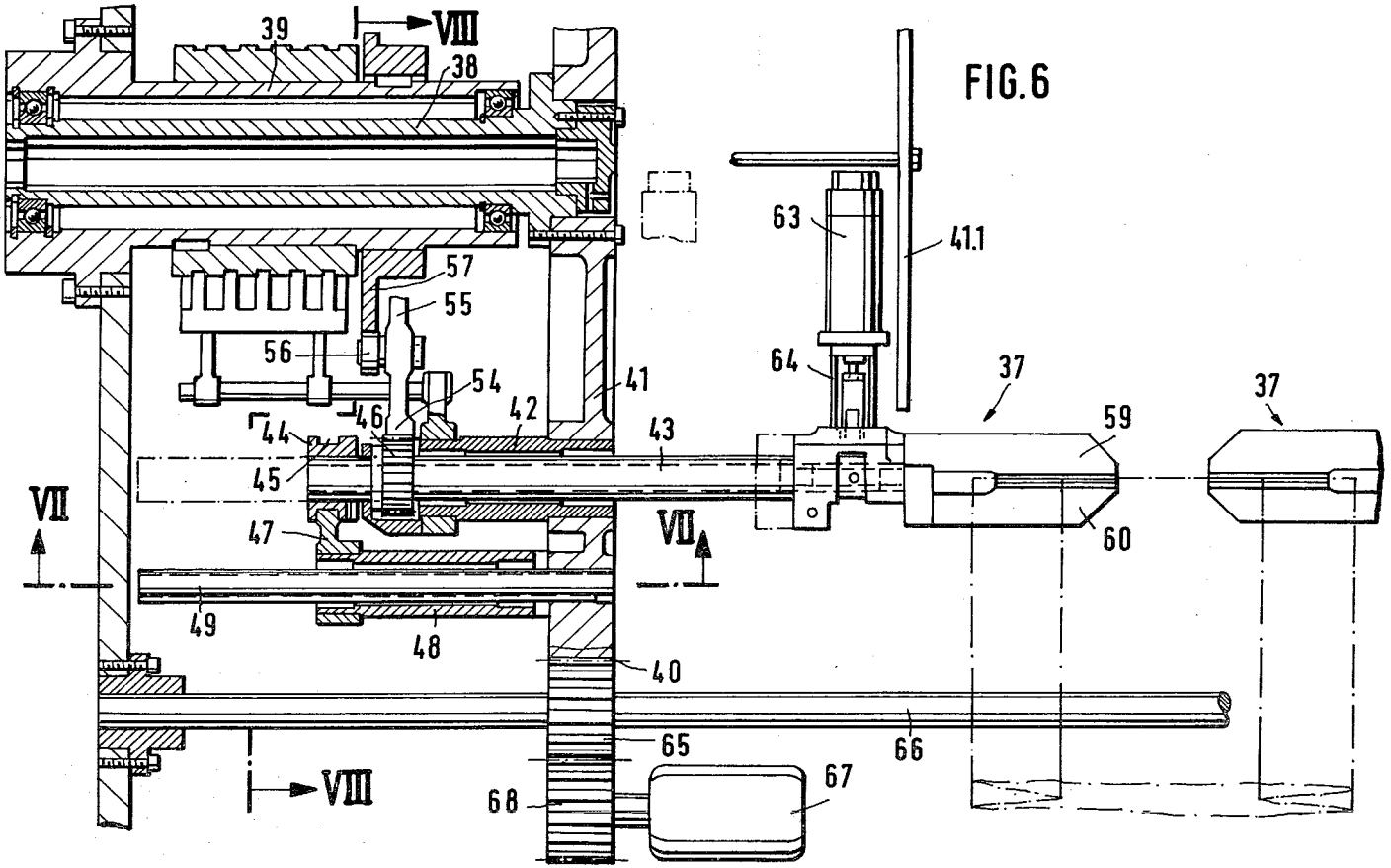
FIG. 6 is a section on the line VI—VI in FIG. 8.
Figure 7:
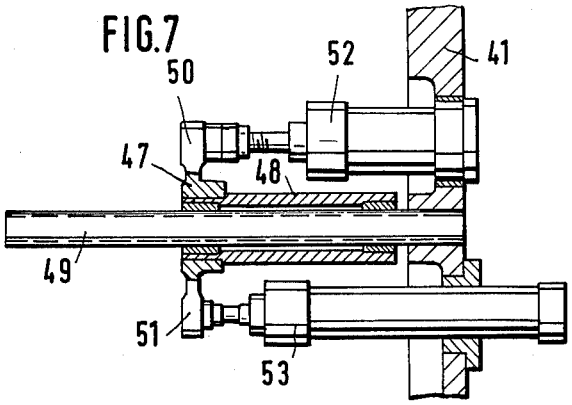
FIG. 7 is a section on the line VII—VII in FIG. 6.
Figure 13:
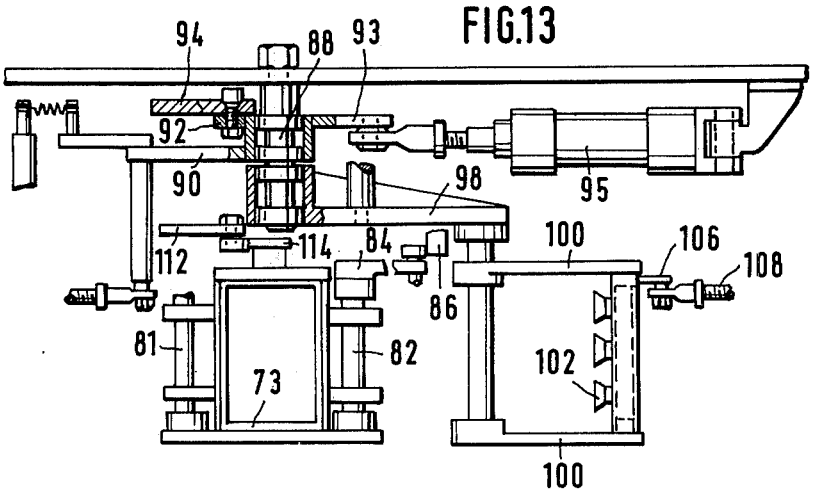
FIG. 13 is a plan view of the filling station with some of the details being omitted.
Figures 8, 9, 10, 11, 12:
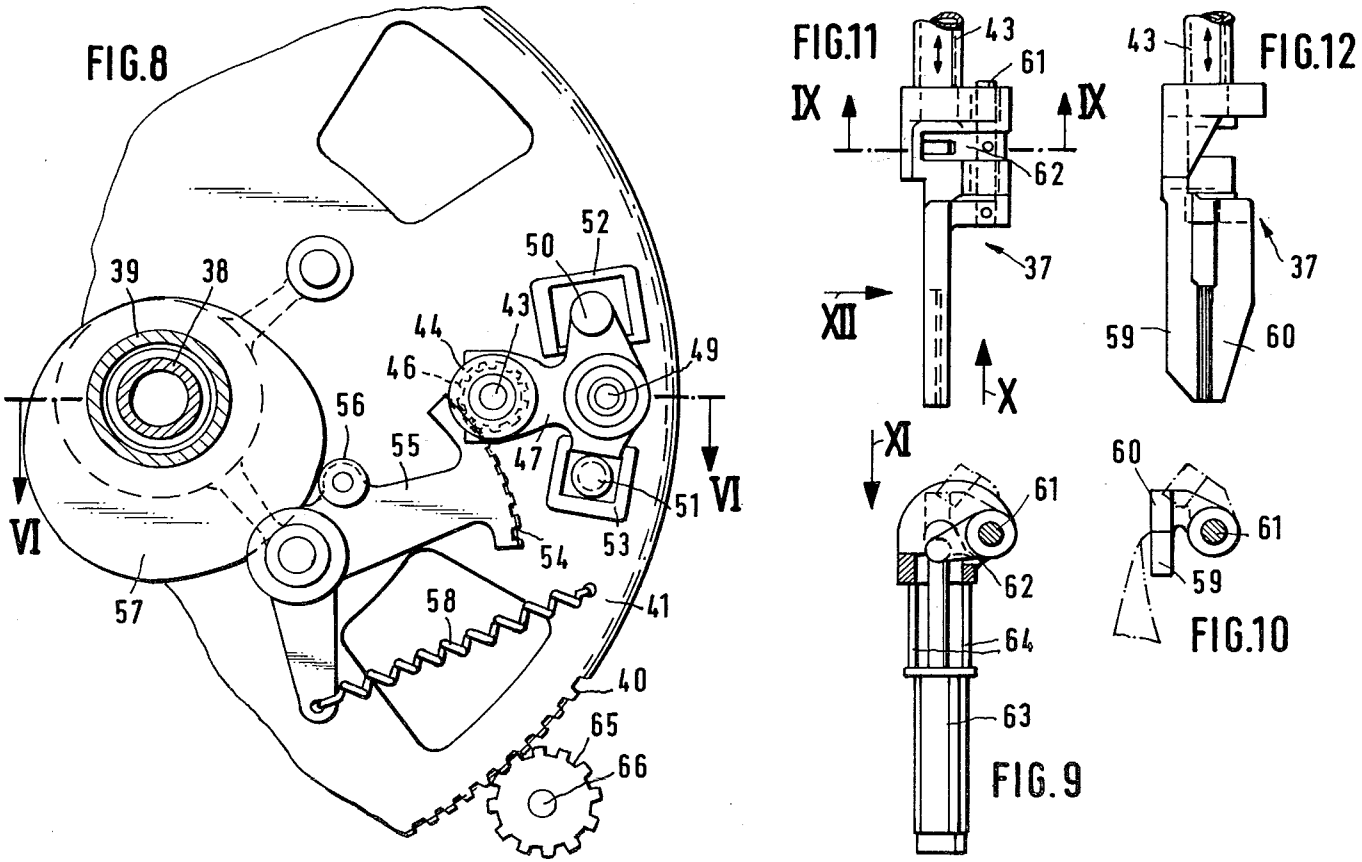
FIG. 8 is a section on the line VIII—VIII in FIG. 6.
FIG. 9 is a section on the line IX—IX in FIG. 11.
FIG. 10 is an elevation in the direction X in FIG. 11.
FIG. 11 is an elevation in the direction XI in FIG. 9.
FIG. 12 is an elevation in the direction XII in FIG. 11.
Figure 14:
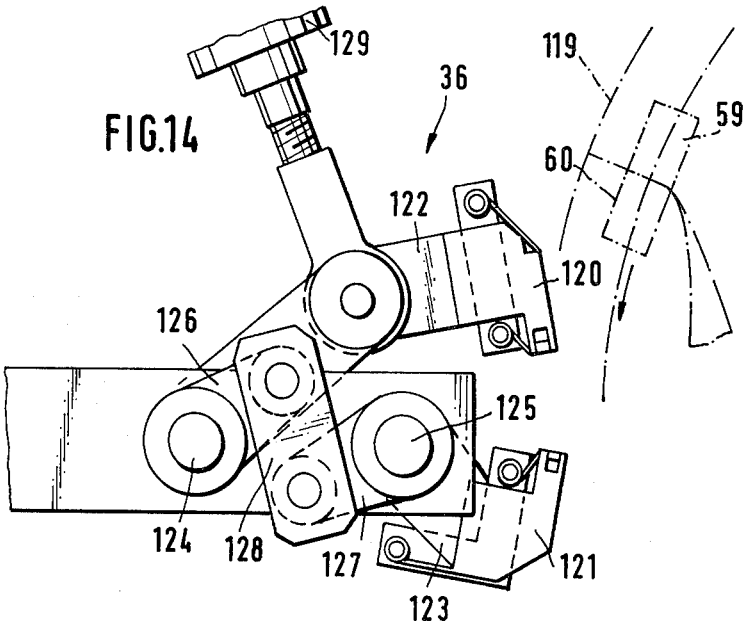
FIG. 14 is an end elevation of the welding station in an open position.
Figure 15:
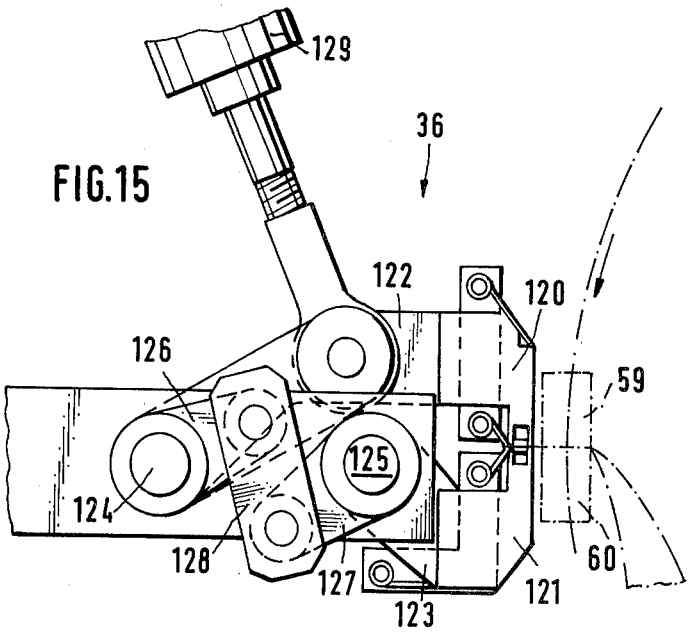

FIG. 15 in the operating position and

Figure 16:
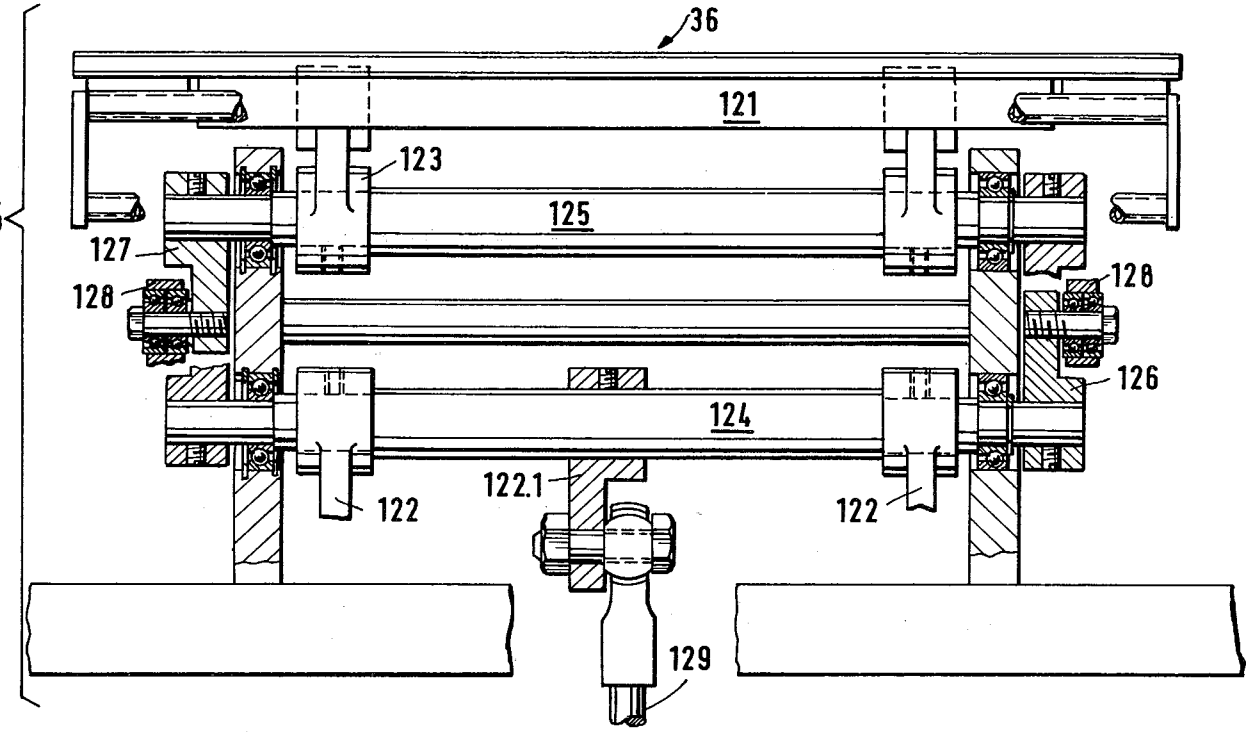

FIG. 16 is a plan view of the welding station.

Side-pleated bags or sacks open at the top are withdrawn from a supply reel 1 on which they are coiled in overlapping relationship with the aid of holding bands and they are taken away in the horizontal direction in an overlapping formation by conveyor belts 2. The conveyor belts 2 run over tensioning or guide rollers 3 to 10. The runs of the conveyor belts 2 coming from the guide rollers 3 and 4 lie against the storage reel 1 and set same into rotation when they are started. The holding bands holding the overlapping sacks on the storage reel 1 are successively drawn off as the overlapping sacks are uncoiled and they are wound on spools 11. Further details of this apparatus are described in Patent Application P 25 26 432.8. As an extension of the runs of the conveyor belts 2 passing over the guide rollers 4, 5 there is a further conveyor belt guide 12 of which the conveyor belts 13 pass over guide or tensioning rollers 14 to 18. Above the guide roller 14 there is a raisable and lowerable roller 19 which is lowered in cycles, engages the front open end of one of the sacks or bags withdrawn by the conveyor belts 2 and clamps it between itself and the guide roller 14. The conveyor belts 2 are intermittently operated and move only until the front end of a sack comes to lie under the roller 19 by means of the control described in Patent Application P 25 26 432.8. The belt guide 12 moves continuously so that, on lowering of the roller 19, the foremost sack of the overlapping formation is engaged and withdrawn. As an extension of the belt guide 12 there is a guide plate 20 which is rigidly connected by levers 22 to the shaft 21 on which the guide rollers 15 are loosely rotatable. One end of the shaft 21 is also rigidly connected to a lever 23, to the free end of which the piston rod of a pressure medium piston cylinder unit 24 is hinged of which the cylinder body is movably attached to the frame of the apparatus. The other end of the shaft 21 is connected to a cam 25.

A pair 26 of tipping rollers 26 loosely rotatable on stub axles 27 is arranged above the roller 15. The stub axles are secured to levers 28 which are rigidly connected to a shaft 29 which is loosely rotatable in the frame and to which there is secured a lever 30 at the free end of which a roller 31 is loosely rotatable. The roller 31 lies in the operating plane of the cam 25 through the movement of which the pair 26 of tipping rollers is raised or lowered. On actuation of the pressure medium piston cylinder unit 24, the guide plate 20 is swung to the position 20.1 in chain-dotted lines and the tipping rollers 26 are lowered onto the roller 15 by turning the cam 25 to the position 25.1.

The bag or sack delivered by the belt guide 12 strikes with its front open end an abutment 32 provided at the front end of the guide plate 20. The constantly circulating conveyor belts 13 delivering the bag slide past under it whilst it lies against the abutment 32 and is in a waiting position.

At both sides the guide plate 20 has incisions 33 which permit the bag or sack to be engaged at the upper edge in the region of its side folds by the gripping tongs of supply or conveying means 34 which lead it firstly to a filling station 35 and then to a closing station 36.

The supply means 34 comprise eight gripping tongs 37, every two gripping tongs 37 engaging a bag or sack at both sides. At each side of the frame, two stub shafts 38 are loosely rotatably and coaxially mounted in bearing bushes 39 that are fixed with respect to the frame. They form the rotary axis of the supply means 34. Rigidly connected to each stub shaft 38 there is a disc 41 having end teeth 40 and on which four gripping tongs 37 are mounted at equal spacings from one another. For this purpose four bearing bushes 42 are secured in each disc 41, tubes or rods 43 being displaceably and rotatably mounted in these bushes. The gripping tongs 37 are rigidly connected to that end of each tube or rod 43 which faces the centre of the machine and a sliding sleeve 44 having an annular recess 45 and a pinion 46 are rigidly connected to each other end. A claw fork 47 seated on a sleeve 48 engages in the recess 45. The sleeve 48 is mounted for easy displacement on a pin or tube 49 secured in the disc 41. The claw clutch 47 comprises two eyes 50, 51 of which the eye 51 is rigidly connected to the piston rod of a pressure medium piston cylinder unit 53. The eye 50 serves as an abutment for the piston rod of a pressure medium piston cylinder unit 52 when it is projected, i.e. it thereby limits the return stroke of the pressure medium piston cylinder unit 53.

The pressure medium piston cylinder units 52, 53 are secured in the disc 41. The pressure medium piston cylinder unit 52 has a short stroke and the pressure medium piston cylinder unit 53 has a long stroke. In mesh with the pinion 46 there is a gear segment 54 which is a component of a double lever 55 pivotably mounted in the disc 41. Loosely rotatably mounted on one arm of the double lever 55 there is a roller 56 which runs along a cam plate 57 which is fixed with respect to the frame in so far that it is connected to the bearing bush 39. By means of a tension spring 58 connected to the other arm of the double lever 55 and having its other end secured to the disc 41, the roller 56 is held in intimate contact with the cam plate 57. On rotation of the discs 41, the gripping tongs 37 are set into right-hand or left-hand rotation by the cam and gear train 57, 56, 55, 54, 46 in accordance with the construction of the cam plate 57 and, by means of the pressure medium piston cylinder units 52, 53, the gripping tongs 37 can be displaced in the longitudinal direction of the tube 43.

Each gripping tongs 37 consist of a fixed segment 59 and a movable segment 60. The tongs segment 60 is secured to a shaft 61 which is rotatably mounted in the tongs segment 59 and which is rigidly connected to a lever 62 of which the free end is hinged to the piston rod of a pressure medium piston cylinder unit 63. The pressure medium piston cylinder unit 63 is connected to the fixed tongs segment 59 by means of spacer bolts 64. The gripping tongs 37 can be closed or opened by actuating the pressure medium piston cylinder units 63.

Deflecting or protecting plates 41.1 are secured to the discs 41 at a certain spacing from the disc 41, the plates comprising apertures for the gripping tongs 37. By projecting the cylinder units 53, the gripping tongs 37 can enter the spaces between the protecting plates 41.1 and the discs 41.

In mesh with the teeth 40 of the discs 41 there are pinions 65 which are seated on a shaft 66 that is loosely rotatably mounted in the two side frames of the machine and of which one is driven by a pinion 68 secured to the shaft of a motor 67. This arrangement ensures that both discs 41 run in synchronism. They are intermittently driven to turn through 90° so that a bag or sack lying against the abutment 32 on the guide plate 20 is engaged by the gripping tongs 37 when the discs 41 are stationary and can be led to the filling station 35 after starting of the motor 67. To engage the bag or sack, the piston rods of the pressure medium piston cylinder unit 53 are retracted whilst the piston rods of the pressure medium piston cylinder unit 52 remain projected and serve as abutments because, by reason of a more intensive setting of the pressure medium in the pressure medium piston cylinder unit 62 or larger dimensioning of the piston surface thereof, the force exerted thereby is greater than that exerted by the pressure medium piston cylinder unit 53.

The gripping tongs 37 move into the space between the protecting plates 41.1 and engage the bags or sacks in the region of their side folds in a manner such that a small strip of the walls of the bag or sack projects beyond the gripping tongs 37, this strip later being welded in the welding station 36. The pressure medium piston cylinder units 63 are then actuated and the gripping tongs 37 are closed. The side fold regions are thereby engaged and the bags or sacks can be withdrawn. On starting the motor 67, the pressure medium piston cylinder unit 24 is actuated, whereby the guide plate 20 is lowered to the position 20.1 and the tipping roller 26 is lowered onto the roller 15. By lowering the tipping roller 26, the rear end of the bag or sack is necessarily conveyed further by the belt guide 12 and the bag or sack is supplied to the filling station 35 in a predominantly vertical position.

The filling station consists primarily of the filling funnel 71 and the sack opening means 72. The filling funnel 71 is formed by the filling connector 73 and the insert flaps 74, 75 which enter the bag opening during filling. The filling connector 73 is suspended from a parallel guide comprising four levers 76 to 79 and can be raised and lowered by a pressure medium piston cylinder unit 80 of which the piston rod is hinged to one of the levers 76 to 79 and the cylinder body is hinged to the frame. The insert flaps 74, 75 are rigidly secured to shafts 81, 82 which are loosely rotatably mounted in the filling connector 73. Secured to the shafts 81, 82 there are levers 83, 84 which, upon lowering, run against abutments 85, 86 fixed with respect to the frame and thereby bring the guide flaps 74, 75 to a splayed position.

Shafts 87, 88 are rotatably mounted in the frame of the machine and levers 89, 90 are secured to them. A further lever 91 is secured to the shaft 87 and further levers 92, 93 are secured to the shaft 88. The levers 91, 92 are pivotably interconnected by a bar 94. The piston rod of a pressure medium piston cylinder unit 95 is hinged to the lever 93 and its cylinder body is pivotally connected to the frame of the machine.

Rotatably mounted on the shafts 87, 88 there are levers 97, 98 at the free ends of which there are arms 99, 100 for suction rows 101, 102 which are mounted in rotary bearings 103, 104 in the arms 99, 100. The suction rows 101, 102 comprise further bearings 105, 106 which are hinged to the levers 89, 90 by bars 107, 108. The levers 89, 97 are interconnected by a tension spring 109 and the levers 90, 98 are interconnected by a tension spring 110 which urges the levers 97, 98 to the closed position shown in full lines. Attachments 111, 112 equipped with rollers are screwed to the levers 97, 98. A bar 114 terminating in a two-sided cam 113 is provided on the filling connector 73. On lowering the filling connector 73, the cam 113 acts on the rollers of the attachments 111, 112 which are moved apart by the cam 113, whereby the levers 97, 98 spread or the suction rows 101, 102 are moved apart. Since the suction rows 101, 102 are guided by the bars 107, 108, they substantially retain their horizontal position. The levers 89, 90 comprise abutments 115, 116 which are struck by abutment pins 117, 118 screwed into the levers 97, 98. On actuation of the pressure medium piston cylinder unit 95, the levers 89, 90 move to a splayed position and, by way of the abutment pins 117, 118, take the levers 97, 98 along to the position 97.1, 98.1 shown in chain-dotted lines. In this position the suction rows 101, 102 are disposed beyond the circle 119 described by the bags or sacks when guided by the gripping tongs 37.

The bags or sacks lying on the guide plate 20 have their opening pointing towards the axis of the discs 41 formed by the shafts 38. During their passage to the filling station 35, they are turned through 180° by the described control by means of the cam and gear trains 57, 56, 55, 54 and 46, so that they will arrive with their opening at the top. The suckers thereupon move to the position shown in full lines. On lowering of the filling connector 73, the bag is opened by the sucker rows 101, 102 moving apart. The pressure medium piston cylinder units 52 are simultaneously retracted so that the gripping tongs 37 move towards one another because the pressure medium piston cylinder units 53 are still set to 'retraction' of the piston rods and the bag or sack can be opened by the sucker rows 101, 102 without applying force. After filling of the bag or sack, the suction air of the sucker rows 101, 102 is turned off. The gripping tongs 37 remain in their filling position so that the walls of the bag opening do not yet close again. The discs 41 are now turned further through one quarter of one revolution and the bag or sack arrives at the closing station 36. This primarily consists of welding tongs with an upper portion 120 and a lower portion 121 which are seated on levers 122, 123 secured to shafts 124, 125 that are loosely rotatably mounted in the frame. Further levers 126, 127 of which the free ends are pivotally interconnected by a bar 128 are secured to the shafts 124, 125.

Hinged to a further lever 122.1 that is also connected to the shaft 124 there is a piston rod of a pressure medium piston cylinder unit 129 of which the cylinder body is pivotally secured to the frame. By actuating the pressure medium piston cylinder unit 129, the welding tongs 120, 121 are opened and closed.

Whilst conveying the bag or sack from the filling station 35 to the closing station 36, the gripping tongs 37 retain their position, i.e. at the closing station the opening of the sack likewise points radially outwardly from the axis of the discs 41 defined by the shafts 38, and the filling opening is, as was already mentioned, still in the filling position. The bag or sack weighted by the filling material hangs vertically from the gripping tongs 37 so that the walls of the bag or sack are angled at 90° to one another at the gripping tongs 37 in front of the welding tongs 120, 121.

Beneath the closing station 36 there is a conveyor belt 130 which is driven by a motor 131 and moves constantly. It is adjustable for height. The spacing from the closing station 36 is selected so that the bag or sack conveyed from the filling station 35 to the closing station 36 stands upright on the conveyor belt 130 even before the gripping tongs 37 have reached the welding tongs 120, 121. The upper end of the bag or sack is therefore slightly buckled by the gripping tongs 37 and the enclosed air can escape through the filling opening. The pressure medium piston cylinder units 53 are then switched over and their piston rods projected so that the filling opening of the bag or sack closes.

The end of the walls projecting beyond the gripping tongs 37 is now welded together over the entire width by means of the welding tongs 120, 121.

Thereafter the gripping tongs 37 are opened by actuating the pressure medium piston cylinder units 63. They move back to behind the protecting plates 41.1 because the pressure medium piston cylinder units 53 are still subjected to the bias of their pressure medium. During the next step of the discs 41, the two gripping tongs 37 here under consideration reach their lowermost position and during the next but one step they again arrive in the vicinity of the guide plate 20. During this passage they are returned to their starting position by the cam and gear train control 57, 56, 55, 54, 46. The cycle can now be repeated.

The guide means 34 preferably do not comprise a continuous shaft. Instead, the mounting of the discs 41 is, as was described, divided into the two shafts 38 and provides a passage for long bags or sacks at the centre below the filling station 35 so that, in comparison with a machine having a throughgoing shaft, the apparatus permits a smaller construction because the sacks can hang freely in the region of the shaft of the discs 41.

We claim:

1. An apparatus for automatically filling and closing sacks, preferably side pleated sacks comprising a frame having an axis; supply means with respect to the frame for supplying sacks; filling means for filling sacks and having means for opening a sack to be filled and having a movable filling funnel; welding means for welding filled sacks; take away means for removing filled sacks; said supply means, said filling means, and said welding means being positioned in equal angular steps about the frame axis; and conveying means intermittently rotatable in equal angular steps about the frame axis for sequentially transferring sacks between the supply means, filling means, and welding means; the sacks having upper regions defining filling apertures; and the conveying means comprising:

two spaced-apart rotatable vertical axis (41) having facing inner surfaces;

two support shafts (38) for supporting said two discs, said support shafts being horizontal, coaxial, and rotatable and having outer ends connected to the frame and inner ends facing and spaced-apart from each other, the inner ends supporting said discs with a space between their facing inner surfaces;

rotation means for synchronously rotating said two support shafts so that said vertical discs are intermittently rotated in equal angular steps;

pairs of aligned shafts (43) positioned in equal angular steps on said two discs (41), the shafts of each pair of aligned shafts being displaceable towards and away from each other and the pairs occupying positions offset eccentrically from each other and from the axis of the frame during rotation of said vertical discs;

confronting tongs (37) secured on each of said aligned shafts; and controlled rotary drive means (46, 54, 55, 56, 57) operatively associated with said rotation means and said confronting tongs for moving said confronting tongs into a position for engaging at both sides of its filling aperture a sack supplied by said supply means, for sequentially moving the tongs to transport an engaged sack from the supply means to the filling means and to transport a filled sack from the filling means past the welding means to the take away means, said confronting tongs being moved to deposit the filled sack on the take away means in such manner that the upper region of the filled sack is buckled, pulled taut, and turned through 90° prior to welding.

2. Apparatus according to claim 1, wherein the controlled rotary drive means includes a sliding sleeve (44) and a pinion (46) associated with the shafts (43) carrying the confronting tongs (37).

3. Apparatus according to claim 2, wherein the controlled rotary drive means further comprises a claw fork (47) engageable with the sliding sleeve (44) and a first pressure medium piston cylinder unit (53) for driving the claw fork.

4. Apparatus according to claim 3, further comprising a second pressure medium piston cylinder unit (52) associated with and acting as an abutment for the sliding sleeve (44).

5. Apparatus according to claim 2, wherein the controlled rotary drive means further comprises a gear segment (54) for driving the pinion (46), a lever (55) for driving the gear segment, a cam (57) for controlling movement of the lever, and a spring (58) for urging the lever into contact with the cam.

6. Apparatus according to claim 1, characterised in that each of the confronting tongs (37) comprises a fixed segment (59), a movable segment (60) hinged to the fixed segment, a lever (62) for moving the movable segment, and a pressure medium piston cylinder unit (63) for driving the lever.

7. Apparatus according to claim 1, further comprising deflecting or protecting plates (41.1) attached to the facing inner surfaces of the discs (41).

8. Apparatus according to claim 1, further comprising a common shaft (66) positioned parallel to the horizontal shafts and extending between the discs (41), and engaging pinions (65) seated on said common shaft, said discs (41) having teeth (40) engageable with said engaging pinions.

9. Apparatus according to claim 1, characterised in that the supply means includes means for positioning the sacks ready to be engaged by the confronting tongs (37) having a belt guide (12) comprising a guide plate (20) for carrying a front end of the ready positioned sack, a shaft (21) for mounting the plate, and a pressure medium piston cylinder unit (20) for pivoting the shaft.

10. Apparatus according to claim 1, characterised in that the filling means comprises rows of suckers (101, 102) for opening engaged sacks, levers (99, 100) and bars (107, 108) for mounting the rows of suckers, and corresponding bearings (103, 104 or 105, 106) for the levers and bars in the nature of a parallel guide.

11. Apparatus according to claim 1, wherein said take away means includes a conveyor belt (130) adjustable for height for taking away the filled sacks after welding.

* * * * *